US005597155A

United States Patent [19]

Guido et al.

[11] Patent Number: 5,597,155

[45] Date of Patent: Jan. 28, 1997

[54] DUAL DRIVE DOCUMENT DESKEW SHEET FEEDER

[75] Inventors: Joseph Guido, Elmira; Kenneth S. Seymour, Conestogo; Murray R. Zink, Waterloo, all of Canada

[73] Assignee: NCR Corporation, Dayton, Ohio

[21] Appl. No.: 606,664

[22] Filed: Feb. 26, 1996

Related U.S. Application Data

[63] Continuation of Ser. No. 146,390, Nov. 1, 1993, abandoned.

[51] Int. Cl.[6] ..... B65H 3/06

[52] U.S. Cl. ..... 271/119; 271/272

[58] Field of Search ..... 271/4, 10, 228, 271/258, 265, 272, 273, 274, 119, 120

[56] References Cited

U.S. PATENT DOCUMENTS

| | | | |
|---|---|---|---|
| 5,187,374 | 2/1993 | Rogers | 250/561 |
| 5,267,008 | 11/1993 | Rebres et al. | 271/119 X |

FOREIGN PATENT DOCUMENTS

| | | | |
|---|---|---|---|
| 0418515 | 3/1991 | European Pat. Off. . | |
| 0529538 | 3/1993 | European Pat. Off. . | |
| 69426 | 3/1989 | Japan | 271/119 |
| 242330 | 9/1989 | Japan | 271/119 |
| 317938 | 12/1989 | Japan | 271/228 |
| 132024 | 5/1990 | Japan | 271/119 |
| 128842 | 5/1991 | Japan | 271/228 |
| 111370 | 5/1991 | Japan | 271/272 |
| 264429 | 11/1991 | Japan | 271/228 |
| 144859 | 5/1992 | Japan | 271/228 |
| 133936 | 5/1992 | Japan | 271/272 |
| 164731 | 6/1992 | Japan | 271/119 |
| 277151 | 10/1992 | Japan | 271/228 |
| 10327445 | 11/1992 | Japan | 271/228 |
| 323134 | 11/1992 | Japan | 271/228 |

OTHER PUBLICATIONS

Patent Abstracts of Japan, vol. 17, No. 155, (M-1388), 26 Mar. 1993, & JP-A-04 323 134 (Omron Corp.), 12 Nov. 1992, abstract.

Patent Abstracts of Japan, vol. 17, No. 417 (M-1457), 4 Aug. 1993, & JP-A-05 085 642 (Canon Inc.), 6 Apr. 1993, abstract.

Patent Abstracts of Japan, vol. 18, No. 179 (M-1583), 28 Mar. 1994, & JP-A-05 338 859 9 (Fuji Xerox), 21 Dec. 1993, abstract.

*Primary Examiner*—William E. Terrell
*Assistant Examiner*—T. Kelly
*Attorney, Agent, or Firm*—Michael Chan; Elmer Wargo

[57] ABSTRACT

A dual drive document deskew and sheet feeder. Paper sheets of various sizes and thicknesses are joggled and aligned into a stack relative to one side and a top of the documents, for example, and the stack is placed in a hinged hopper which is pivoted to be raised relative to left and right special picker rollers. Left and right drive rollers located downstream in a feeding direction from the picker rollers are independently driven by left and right drive stepper motors. Sensors which interact with the leading edge of a document are used to sense whether the document is skewed relative to the feeding direction. A controller receives the outputs from the sensors, and the outputs are used to dynamically deskew the document so that it can be fed into a document receiving apparatus in a deskewed or aligned orientation. The special picker rollers subject the top document being fed to alternating high and low friction forces which minimizes double feeds. Stripper rollers, having one way clutches associated therewith and operating with the associated drive rollers, may be used to return a document to the hopper if the document is too skewed to be deskewed within the parameters of the system.

19 Claims, 5 Drawing Sheets

DUAL DRIVE DOCUMENT DESKEW SHEET FEEDER

This is a continuation of application Ser. No. 08/146,390 filed on Nov. 1, 1993 which is now abandoned.

BACKGROUND OF THE INVENTION

1. Field of Invention

This invention relates to a method and apparatus for deskewing sheets of various sizes while picking the sheets from the top of a stack of documents which are placed in a face up orientation and for depositing the sheets in a document receiving apparatus.

2. Background Information

Sheet feeders of the type to which this invention is directed are commonly called automatic document feeders (ADFs). There are several basic problems associated with ADFs; they are:

1. Document skewing;
2. Documents double feeding; and
3. Stack capacity of the hopper, for example, in which the sheets are stored prior to picking the documents from the stack.

Document skewing in a sheet feeder is caused by force couples or unbalanced forces that rotate the sheets as they move through the feeder. In other situations, the documents may be skewed, initially, in a stack of documents from which the individual documents are picked.

When the ADFs are used with utilization devices which include character recognition algorithms and compression algorithms, for example, the accuracy and execution times of these algorithms are adversely affected when the documents are skewed relative to a scanner which provides digital images of the documents being scanned.

Many of the existing ADFs lack the capability for mixing documents of different sizes and weights, for example, or they may require constant attention by an operator.

Also, many of the existing ADFs have single drive elements or rollers located in the center of a path along which the documents are driven. The drive elements pick and feed the documents from a point which is located in the center of the stack of documents. If all the sheets are of the same size, the documents being picked from the stack and being moved in a feeding direction are generally driven along the feeding direction, provided the drag forces working on the document are properly balanced. When the stack contains documents of different sizes, the single feed roller in the center of the stack cannot control skewing of the document being fed.

Some of the existing ADFs have moveable stack guides to center the stack in the transport mechanism to feed the documents along the feeding direction. Even when the stack guides house sheets of a single size, some clearance between the stack of sheets and the guides is necessary. When such a clearance exists, some rotation or skewing of the document may exist as it is moved in the feeding direction.

Some prior art ADFs use a pair of sensors to detect document skew. When the skewing becomes excessive, the output of the sensors is used to flag or highlight the skewing for operator intervention, for example.

Jogging the documents in a document stack is one way for reducing the skew of documents being picked from the stack; this is useful when the documents in the stack are all of the same size. When the documents are not all of the same size, the unbalanced forces mentioned work on the document to deskew the document relative to the intended feeding direction.

Double feeding of documents represents the second problem mentioned with ADFs. Double feeding of documents from a document stack is a serious problem because part or all of the data on the second or unintended document being fed may be lost. Generally, it is easier to feed documents of the same size and thickness than those of varying sizes and thicknesses. When the thicknesses of documents within the stack vary over a narrow range of paper thicknesses, say 0.004 inch (20#) to 0.006 inch (24#), it is not as difficult as feeding documents over a wide range of paper thicknesses ranging from 0.003 inch (14#) to 0.012 inch (100#).

In general, retard rollers are used to minimize the double feeding mentioned. On some equipment, an operator adjusts the pressure on the retard rollers when there is a change in the-thickness of a batch of documents to be processed. The effectiveness of such operator adjustments is generally limited to a paper thickness falling in a small range, typically +/–0.002 inch.

The third problem mentioned with regard to ADFs relates to the storage capacity of the hopper in which the documents are stored prior to feeding. In this regard, the capacity of fixed inclined tray or platform feeders is generally limited to 100 sheets maximum. Most tray feeders generally specify a maximum of 50 sheets. When loading this type of hopper, the operator must fan the stack of sheets so that the top sheet is ahead of the second sheet, and the second sheet is ahead of the third sheet etc. By shingling or cascading the sheets in this manner, the ends of the sheets are set up so that the top sheet feeds first, followed by the sequence of the remaining sheets. Obviously, if the sheets are not fanned properly, double feeds or misfeeds can occur.

In order to feed from the top of a stack of several hundred documents with the sheet picker located near the top of the stack, either the stack has to be raised to keep the "top sheets" against the picker, or the picker must be lowered to reach the top sheet in a stack which decreases in height as documents are picked from the stack. Large capacity sheet feeders (250 sheets and up) which are used with image scanners, typically use horizontal trays which move up and down in an elevator-like manner. The elevator type feeders are complex and expensive to maintain because linear bearings are required to guide the associated horizontal platform on which the stack of sheets is located.

SUMMARY OF THE INVENTION

An object of this invention is to provide an ADF which can accommodate a variety of sizes of documents having a variety of various thicknesses in a single stack of documents to be fed to a utilization device.

Another object of this invention is to provide dynamic deskewing of the various documents mentioned in the previous paragraph so that they are fed along a feeding direction for proper orientation relative to the utilization device mentioned.

A feature of this invention is that when a double feed is detected, the affected documents can be returned to the feed hopper to be fed again. As an alternative, the document need not be returned; however, the double feed condition could be flagged for operator intervention.

In one aspect of this invention, there is provided a sheet feeder comprising:

a hopper for storing a stack of documents to be fed;

a picker mechanism for picking a document from said stack and for moving the document downstream in a feeding direction;

a leading edge detector including first and second sensors positioned downstream from said picker mechanism for generating first and second outputs, respectively, as a leading edge of the document encounters said first and second sensors;

first and second drive rollers positioned between said picker mechanism and said first and second sensors;

first and second motors for driving said first and second drive rollers independently of each other;

a document receiver located downstream from said first and second drive rollers in said feeding direction for receiving said document from said first and second drive rollers; and a controller and a program for receiving said first and second outputs to obtain a measure of skewness of said document approaching said first and second sensors relative to said feeding direction and for controlling the operation of said first and second motors to present said document to said document receiver in a deskewed orientation with respect to said feeding direction.

In another aspect of this invention, there is provided a method of aligning a leading edge of a document perpendicular with regard to a feeding direction, comprising the steps of:

(a) using independently driven first and second drive wheels for feeding the document so that the leading edge approaches a leading edge detector providing outputs in accordance with the position of the leading edge relative to the feeding direction;

(b) using the outputs from the leading edge detector to energize first and second motors, respectively, driving said first and second drive wheels in a first direction, to enable said leading edge to assume a position perpendicular to said feeding direction prior to the leading edge approaching a receiving member.

In yet another aspect of this invention, there is provided a method of minimizing double feeds of documents being fed from a stack of documents, comprising the steps of:

(a) applying a predetermined force in a first direction to a first document in the stack of documents; and (b) subjecting the first document from step (a) to alternating high and low friction forces in a feeding direction which is substantially perpendicular to said first direction.

The above advantages, and others, will be more readily understood in connection with the following specification, claims, and drawing.

DETAILED DESCRIPTION OF THE PREFERRED EMBODIMENT

Figure 1:
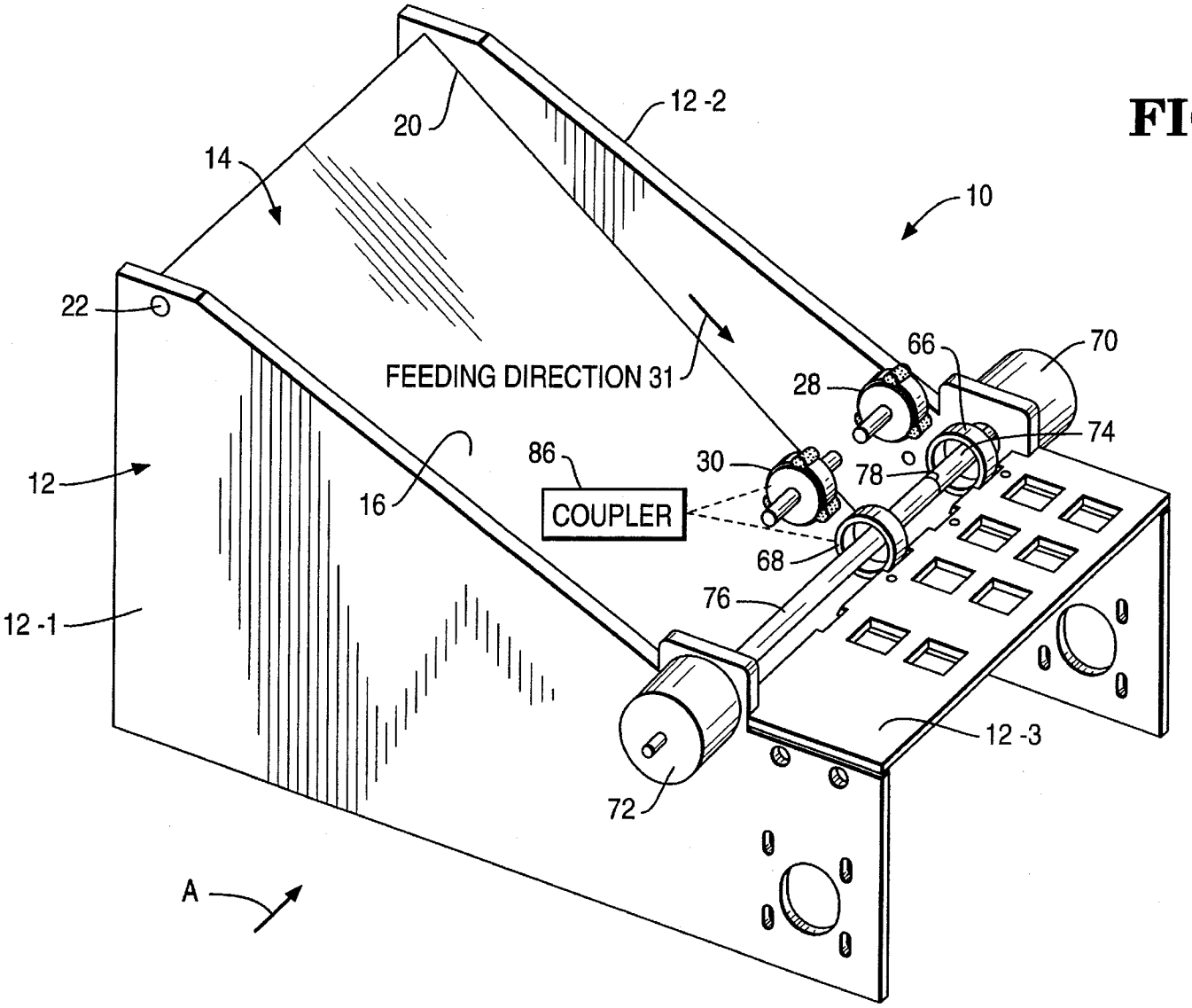
FIG. 1 is a general isometric view, in diagrammatic form, of a preferred embodiment of a document deskew and feeder of this invention, showing a document hopper, a picker mechanism for picking a top document from a stack of documents, and first and second drive rollers for moving a document picked from the hopper in a feeding direction.

FIG. 1 is a general isometric view of a document deskew and sheet feeder 10 (hereinafter referred to as feeder 10) made according to this invention, with the feeder 10 being shown in diagrammatic form to simplify the showing. The feeder 10 includes a frame 12 having first and second vertical supports 12-1 and 12-2 and a cross support 12-3 maintaining the vertical supports in spaced, parallel relationship.

Figure 2:
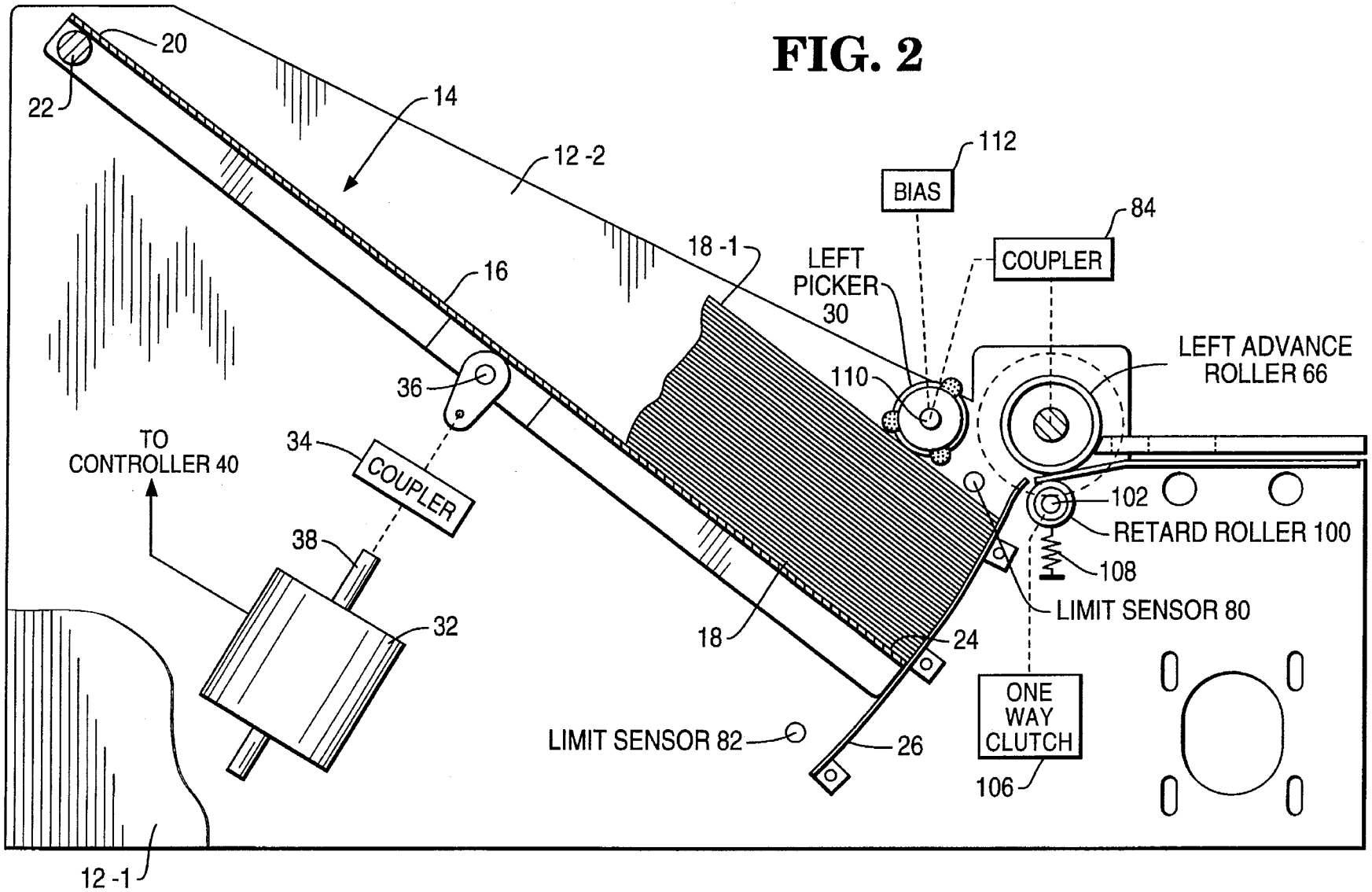
FIG. 2 is a side view of the feeder shown in FIG. 1, taken from the direction of arrow A of FIG. 1, with a vertical support being removed to show the interior of the feeder.

The feeder 10 includes a feed hopper 14 having a receiving area 16 for receiving a stack 18 of documents to be fed, with the stack 18 being shown only diagrammatically in FIG. 2. The receiving area 16 has one end 20 pivotally supported on a rod 22 which is supported in the first and second vertical supports 12-1 and 12-2, and the remaining end 24 (FIG. 2) comes close to an arcuately shaped stop 26. The stack 18 of documents abuts against the stop 26 as the stack 18 is moved upwardly (as viewed in FIG. 2). The top document in the stack 18 of documents is picked by a picker mechanism including a first or left picker roller 28 and a second or right picker roller 30, and it is moved in a feeding direction shown by the arrow 31 (FIG. 1).

Figure 4:
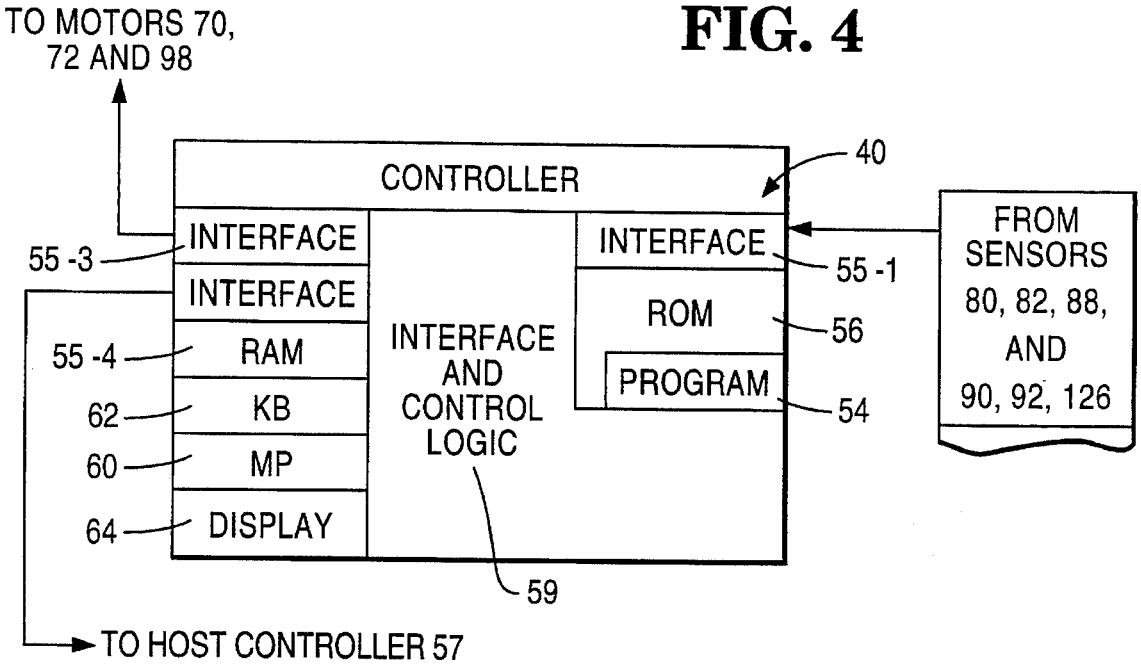
FIG. 4 is a schematic view of a controller which is used to control the feeder of this invention.

The end 24 of the receiving area 16 of the feed hopper 14 moves up and down via a bi-directional stepper motor 32 (FIG. 2) while the other end 20 pivots on the rod 22. A conventional coupler 34 has one end pivotally joined to the bottom of the receiving area 16 (FIG. 2) by a pin 36, and the remaining end of the coupler 34 is coupled to the output shaft 38 of the stepper motor 32. The coupler 34 may be a lead screw drive, or it may include a bell crank lever, for example. The general function of the coupler 34 is to transfer the incremental steps of the motor 32 to raising and lowering the receiving area 16. The receiving area 16 of the feed hopper 14 is lowered when a new supply or stack 18 of documents is to be inserted in the hopper 14, and the receiving area 16 is raised towards the left and right picker rollers 28 and 30 as documents are removed from the top of the stack 18. The motor 32 receives the appropriate energizations from a controller 40, shown only schematically in FIG. 4.

Figure 5:
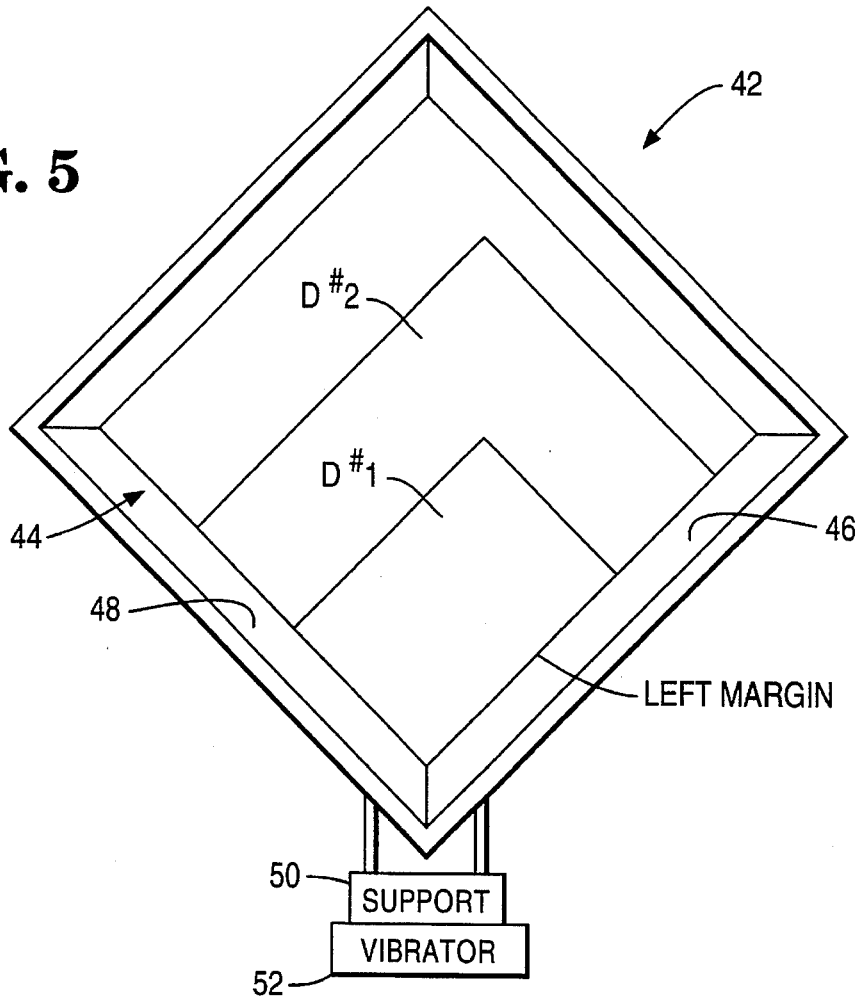
FIG. 5 is a schematic diagram of a jogger which is used to align a stack of documents.

One of the features of the feeder 14 is that it is capable of handling a mix of documents within a stack 18. As an illustration, the feeder 14 is capable of handling a range of documents from a minimum document size of 2¾×4¾ inches to a maximum document size of 11.7×17 inches, with the documents having a paper weight (pounds) of 12# to 100#. Naturally, the techniques of this invention could be used to handle documents of different sizes and paper weights. Because the sizes of the documents can vary so much, it is preferred to jog the stack 18 of documents before placing it in the hopper 14. A conventional jogging machine 42, shown only schematically in FIG. 5 is used to get the variety of documents aligned into a stack 18.

The jogging machine 42 (FIG. 5) has a receiving tray 44 into which the documents are placed. In the embodiment described, the documents are placed in the tray 44 so that the top of each document is facing up (as viewed in FIG. 5) with the documents to be aligned against the left side 46 of the tray. In any system, one has to decide whether the bottom of the document is to be placed against the bottom 48 of the tray or the top of the document is to be placed against the bottom Assume that a particular application requires that the top edge of the document has to be fed first; this means that the top of the document is to abut against the stop 26 in the feeder 10 in FIG. 2. Correspondingly, this means that the top of the document would have to abut against the bottom side 48, and the left side of the document abuts against the left side 46 of the tray 44 when the documents are placed in a face-up orientation in FIG. 5. Notice that a small document #1 and a large document #2 in the tray 42 in FIG. 5 are oriented so that they are aligned with the left and bottom sides 46 and 48 of the tray. A conventional support 50 is used to couple the tray to a conventional vibrator 52.

After the documents are formed into a stack 18, the stack of documents is placed in the hopper 14 (FIG. 2). The operation of the feeder 10 is controlled by software or a program 54 (FIG. 4) which may be stored in a ROM 56 or a RAM 58, with the program being executed by a processor MP 60. A keyboard 62 enables an operator to enter commands to the controller 40, and a display 64 is used to enable the controller 40 to communicate with the operator. The controller 40 has several conventional interfaces 55-1, 55-2, 55-3, and 55-4 for coupling the controller to external members and it also has interface and control logic 59 for coupling the various elements shown. Interface 55-4 may be used to couple the document feeder 10 to a host controller 57.

Whenever an operator wishes to load a stack 18 of documents in the hopper 14, an appropriate key is actuated on the keyboard 62, and the controller 40 energizes the motor 32 in the appropriate direction to lower the receiving area 16 of the hopper 14. The receiving area 16 is lowered automatically when all the documents therein are fed out of the hopper 14. The stack of documents is then placed in the hopper 14 so that the side which contacted the bottom side 48 abuts against the arcuately shaped stop 26, and the left margins of the documents abut against the left side of the hopper 14 which is the second vertical support 12-2 (FIG. 1).

One reason that the documents have to be aligned as just described is that the feeder is designed to handle a range of sizes of documents as mentioned. In order to feed a range of documents with a minimum of twisting or skewing, it is necessary to make sure that the smallest document will be picked from the stack 18 with two "pickers" and driven with two "driving wheels" In this regard, the left picker roller 28 and the right picker roller 30 are spaced from each other and spaced from the left side of the hopper 14 (vertical support 12-2) so as to enable both of these picker rollers mentioned to engage the smallest or the largest document in the stack 18 and move it in a feeding direction towards a first or left advance roller 66 and a second or right advance roller 68.

The advance rollers 66 and 68 are aligned with the picker rollers 28 and 30, respectively. The left advance roller 66 is driven by a first or left stepper motor 70, and the right advance roller 68 is driven by a second or right stepper motor 72. The left advance roller 66 is rotated by a shaft 74 which is coupled to the output shaft of the stepper motor 70, and correspondingly, the right advance roller 68 is rotated by a shaft 76 which is coupled to the output shaft of the stepper motor 72. The shafts 74 and 76 are collinear and are coupled to be held in alignment with each other, but each of these shafts mentioned is able to rotate the associated advance rollers 66 and 68, independently of the other. A coupling shown at line 78, in FIG. 1, may consist of a pin extending from one of the shafts, say shaft 76, while the other shaft 74 has a recess in the center thereof to receive the pin when these two shafts abut against each other.

Some additional members associated with the hopper 14 include an upper limit sensor 80 and a lower limit sensor 82 (FIG. 2). The upper limit sensor 80 is positioned so that it is in an operative position relative to the top of the stack 18 of documents and the left and right advance rollers 66 and 68 and the left and right picker rollers 28 and 30. The sensor 80 contacts the top of the stack 18, and when several documents are removed therefrom, the sensor actuates to indicate to the controller 40 a need for the stack 18 of documents to be raised to get the top document or top few documents into the operative position mentioned in this paragraph. The controller 40 then energizes the motor 32 to raise the stack 18, and when the top limit sensor 80 is actuated again, the controller 40 shuts off the motor 32. When an operator wishes to load a new stack 18 of documents in the hopper 14, an appropriate key on the keyboard 62 is actuated, and the controller 40 responds by actuating the motor 32 in a reverse direction to lower the hopper 14. The motor 32 is turned off by the controller 40 when the receiving area 16 interacts with the lower limit sensor 82 (FIG. 2). After loading a new stack 18 of documents in the hopper 14, an appropriate key on the keyboard 62 is actuated, and the controller 40 raises the stack 18 to the operative level mentioned. In the embodiment described, a stack 18 of documents typically includes about 500 to 600 sheets, with the number depending upon the thickness and condition of the sheets.

The receiving area 16 of the hopper 14 can also be raised periodically after a predetermined number of sheets or documents is fed. For example, assuming that the average thickness of the documents being fed is about 0.004 inch, the motor 32 could be raised 0.04 inch after every ten sheets are fed from the hopper 14. There are sensors (to be later described herein) which can cooperate with the controller 40 to determine when the motor 32 should be raised as described.

Another feature of the hopper 14, as designed, is that having the stack 18 of documents on an inclined plane (receiving area 16) enables the individual documents to abut against the arcuately shaped stop 26. This helps to keep the leading edges of the documents in an aligned position or perpendicular to the feeding direction (arrow 31) in preparation for picking and feeding.

The left picker roller 28 is coupled to the left advance roller 66 by a conventional coupler 84 (shown only schematically in FIG. 2) so that these two rollers operate at substantially the same speed so as to move a document at substantially the same speed. The coupler 84 includes conventional pulleys and belts (not shown) which are not important to an understanding of this invention. The right picker roller 30 and the right advance roller 68 include a similar coupler 86 (shown schematically in FIG. 1) which is used to enable the right picker roller 30 and the right advance roller 68 to rotate at substantially the same speed.

Figure 3:
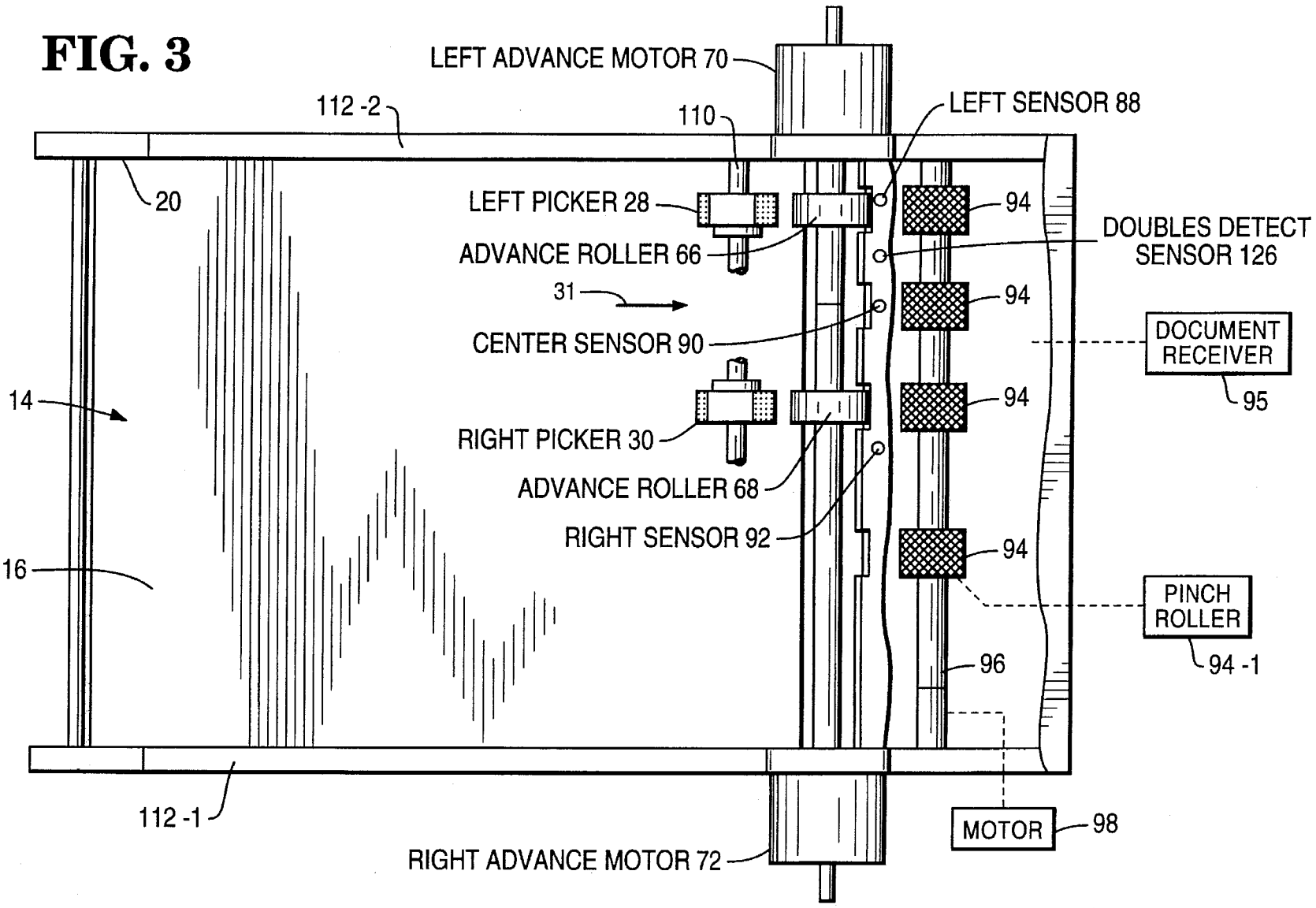
FIG. 3 is a plan view of the feeder shown in FIG. 1.

The feeder 10 also includes a left sensor 88, a center sensor 90, and a right sensor 92, as shown best in FIG. 3, with these sensors being coupled to the controller 40. As a top document 18-1 (FIG. 2) is picked from the stack 18 of documents by the left and right picker rollers 28 and 30, it is moved in the feeding direction 31 towards the left and right advance rollers 66 and 68. If the document 18-1 has its leading edge perpendicular to the feeding direction 31, then the leading edge will encounter the left, center, and right sensors 88, 90, and 92, respectively, at the same time, and the three outputs from these sensors are sent to the controller 40. The controller 40 interprets the three outputs coming at the same time as indicating that the leading edge of the document 18-1 is aligned properly relative to the feeding direction 31. With the document 18-1 being aligned properly, the left and right advance motors 70 a 72 are driven at the same speed by the controller 40 so as to rotate the associate left and right advance rollers 66 and 68 at the same speed to feed the document 18-1 to rubber driving or knurled rollers 94, for example. The knurled rollers 94 are rotated by a single shaft 96 which is coupled to a motor 98 (shown only schematically in FIG. 3), with the motor 98 being under the control of the controller 40. There are about two inches of spacing between the advance rollers 66 and 68 and the knurled rollers 94 in the embodiment described. The knurled rollers 94 are part of a document receiver 95 which is shown only schematically in FIG. 3. Each knurled roller 94 cooperates with an associated pinch roller 94-1 shown only schematically in FIG. 3. The document receiver 95 may be considered a utilization device, like an imager, for example, which may be used to perform certain operations on the documents being fed thereto. The document receiver 95, itself, may have an additional document transport system (not shown) for feeding documents received from the knurled rollers 94.

When a document 18-1 is correctly aligned relative to the feeding direction 31 as discussed in the previous paragraph, and the document 18-1 is gripped by the knurled rollers 94 and the associated pinch rollers 94-1 to continue to move the document 18-1 in the feeding direction, the controller 40 places the left and the right stepper motors 70 and 72 in a "coasting" mode. If these stepper motors 70 and 72 were placed in an "idle" mode by the controller 40 when the document is gripped by the knurled rollers 94, these stepper motors would cause a drag on the document being fed by the motor 98. Putting the stepper motors 70 and 72 in the coasting mode simply puts enough energy into these motors so that they do not put a drag on the document 18-1 being fed, as this would interfere with the feeding of the document 18-1 by the knurled rollers 94 and the motor 98.

When a document 18-1 is picked from the stack 18 of documents, and the leading edge of the document is skewed relative to the feeding direction 31, assume that it is the left side of the leading edge of the document (as viewed in FIG. 3) that leads the right side of the document. This means that the left sensor 88 will be actuated prior to the center sensor 90 and the right sensor 92 being actuated. The timing of outputs from the various sensors 88, 90, and 92 gives a measure of "skewness" of the document 18-1.

Continuing with the example being discussed in the previous paragraph, if the left sensor 88 is covered first by the leading edge of a document 18-1, a timer associated with the controller 40 is started. If the right sensor 92 does not encounter the leading edge of the document 18-1 within a predetermined amount of time, it means that the leading edge of the document is skewed beyond acceptable limits of "skewness", and that deskewing must take place. In this situation, the controller 40 deenergizes the left advance roller 66, permitting it to stop and wait while the right advance roller 68 continues to feed the document 18. When the leading edge of the document 18-1 encounters the right sensor 92, the controller 40 introduces a slight delay before energizing the left advance roller 66. This slight delay accounts for the slight distance which the left side of the leading edge of the document 18-1 moved prior to the controller 40 deenergizing the left advance motor 70. When both the left and right motors 70 and 72 are running, the leading edge of the document 18-1 should be positioned perpendicular to the feeding direction 31. The timing and delays mentioned in this paragraph are dependent upon the geometry of a particular application, and these factors can be conventionally determined. A document 18-1 which is skewed with the right side leading would be correspondingly deskewed. If the time difference between the left sensor 88 being energized and the right sensor 92 being energized, for example, is beyond predetermined limits it means the document 18-1 is too skewed to be handled by the technique just mentioned.

Continuing with the example being discussed, if the left advance motor 70 is stopped, waiting for the right side of the document 18-1 to reach the right sensor 92, and if the amount of time on the timer in the controller 40 indicates that too much time has elapsed, the left advance motor is driven in the reverse direction to aid in the deskewing process. When the right side of the leading edge of the document 18-1 does encounter the right sensor 92, the controller 40 will deenergize the right advance motor 72 and wait until the reversing left advance motor 70 moves the left side of the leading edge of the document 18-1 back towards the hopper 14 until the left sensor 88 is uncovered; the left advance motor 70 is then deenergized. Thereafter, both the left and the right advance motors 70 and 72 are energized in the forward direction to move the document 18-1 in the feeding direction 31.

While the feeder 10 can work with only the left and right sensors 88 and 92, a document which has a corner folded over or "dog eared" may give the impression that the leading edge thereof is skewed when using only two sensors. With three sensors, this potential problem is obviated. The outputs from the sensors 88, 90, and 92 may be used to provide a count of the documents being fed therepast. This count may be used by the controller 40 to indicate that a predetermined number of documents has been removed from the hopper 14, and that the motor 32 should be energized to raise the receiving area 16 of the stack 18 of documents for proper picking, as previously discussed.

The feeder 10 also includes a retard mechanism including retard rollers, like retard roller 100 shown in FIG. 2. There is one retard roller 100 positioned in opposed relationship with the advance rollers 66 and 68 to function as a retard mechanism to enable only one document 18-1 to be fed at a time from the hopper 14. Each retard roller 100 is coupled to its own stationary shaft 102 by a one way clutch 106, shown only schematically in FIG. 2. The clutch 106 prevents the retard rollers 100 from rotating in a clockwise direction, as viewed in FIG. 2; this enables the retard rollers 100 to function as a retard mechanism to enable only one document 18-1 at a time to be picked from the stack 18. The retard rollers 100 can independently rotate in a counterclockwise direction, as viewed in FIG. 2, when the associated advance roller 66 or 68 is driven in the reverse direction to move the document 18-1 towards the hopper 14. Each clutch 106 is mounted between its associated stationary shaft 102 and the associated retard roller 100. Each stationary shaft 102 is mounted on a resilient member or spring 108 to resiliently bias the retard roller 100 towards the associated advance roller (66 and 68). This facilitates handling the different thicknesses of documents anticipated in the stack 18 and also minimizes adjustments which might be necessary because of wear on the retard rollers 100. Because the retard rollers 100 are stationary for the most part, it is conceivable that an excessive amount of wear may occur on the periphery of the rollers. To counter the wearing just mentioned, the controller 40 actuates the advance motors 70 and 72 to move the retard rollers slightly in a counterclockwise direction each time the hopper 14 is lowered to place a new stack 18 of documents therein.

When a document 18-1 needs to be moved back into the stack 18, as mentioned, the controller 40 energizes the advance motors 70 and 72 causing the associated advance rollers 66 and 68 to rotate in a clockwise direction (FIG. 2), causing the associated retard rollers 100 to rotate in a counterclockwise direction to move the document 18-1 in a direction opposite to the feeding direction shown by arrow 31. This will be explained in more detail hereinafter.

A feature of this invention is that if too long a time takes place between the energization of one sensor and the energization of another sensor as discussed earlier herein, the document 18-1 is fed back into the hopper 14. In order to accomplish this, several activities must happen. The controller 40 actuates the motor 32 in a direction which lowers the feed hopper 14 to make room for the document 18-1 to be moved back onto the stack 18. After the feed hopper 14 is lowered, the controller 40 energizes the advance motors 70 and 72 in the reverse direction, as previously discussed, and the associated advance rollers 66 and 68 and retard rollers 100 are used to return the document 18-1 to the hopper 14. The controller 40 then deenergizes the advance motors 66 and 68 when the leading edge of the document 18-1 has been moved back into the hopper 14.

An alternate system of control which could be employed in the feeder 10 is to have the controller 40 energize the left and right advance rollers 66 and 68 to move the document 18-1 in a feeding direction until the leading edge of the document 18-1 moves beyond the sensors 88, 90, and 92. During the time that the leading edge of the document moves beyond the sensors 88, 90, and 92, the order of actuation of these sensors provides the controller 40 with a measure of the skewness of the document 18. The controller 40 then reverses the direction of the advance motors 70 and 72, causing the advance rollers 66 and 68 to drive the document 18-1 back towards the hopper 14. The retard rollers 100 then rotate in a counterclockwise direction (as viewed in FIG. 2) to enable the document 18-1 to be driven in the direction of the hopper 14. From the pattern of the energization of the sensors 88, 90, and 92, the controller 40 controls the energization of the advance motors 70 and 72 to align the leading edge of the document perpendicular to the feeding direction. Once the document 18-1 is aligned, the controller 40 controls the motors mentioned to move the aligned document in the feeding direction.

Another feature with the system mentioned is that the controller 40 can attempt to align the document 18-1 as it is moved in the feeding direction (arrow 31), and if it is not aligned while traveling in the feeding direction, the controller 40 can attempt to deskew the document 18-1 as the document is moved back towards the hopper 14 as discussed in the previous paragraph.

Another feature of this invention is that it includes a double feed control to minimize two or more documents 18-1 being picked or fed at the same time. In the embodiment described, the left and right picker rollers 28 and 30 are alike, so only a description of picker roller 28 (FIGS. 2, 6, and 7) will be given. The left picker roller 28 is mounted on a shaft 110 which is biased towards the first or top document 18-1 in the stack 18 by a conventional bias 112, shown only schematically in FIG. 2. The bias 112 is used to maintain a force perpendicular to the stack 18. When a document 18-1 is to be picked from the stack 18, the picker roller 28 is rotated in a counterclockwise direction as viewed in FIG. 2. This action moves the top document towards the left and right advance rollers 66 and 68 and their associated retard rollers, like 100. Because of the force which is perpendicular to the stack 18, some of the feeding motion of the top document will be transferred to the second or third documents underneath. Excessive forces which are normal to the stack 18 of documents and overly aggressive picking are the major causes of double feeding.

Figure 6:
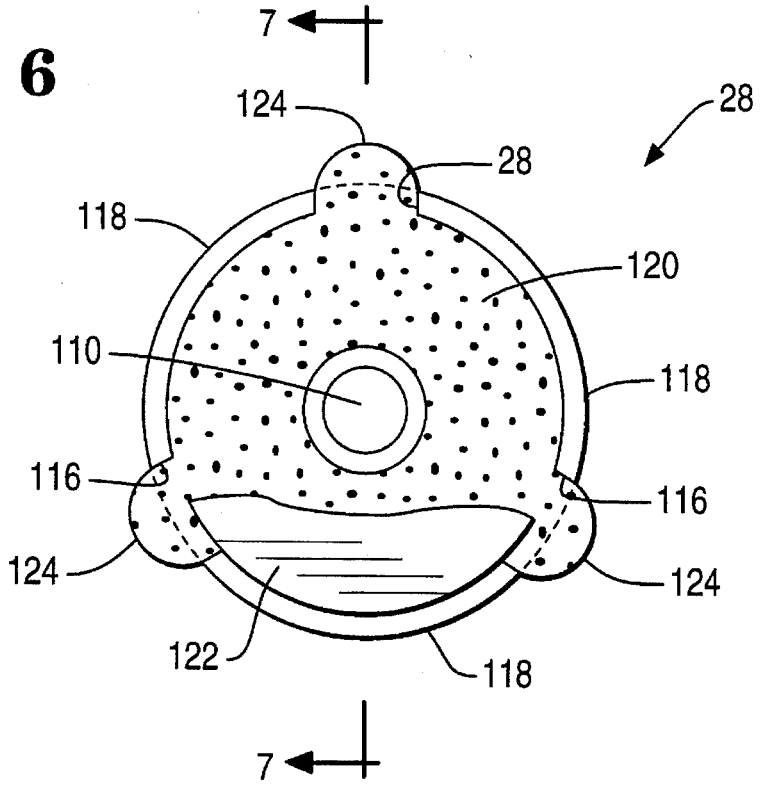
FIG. 6 is an end view of a picker roller.
Figure 7:
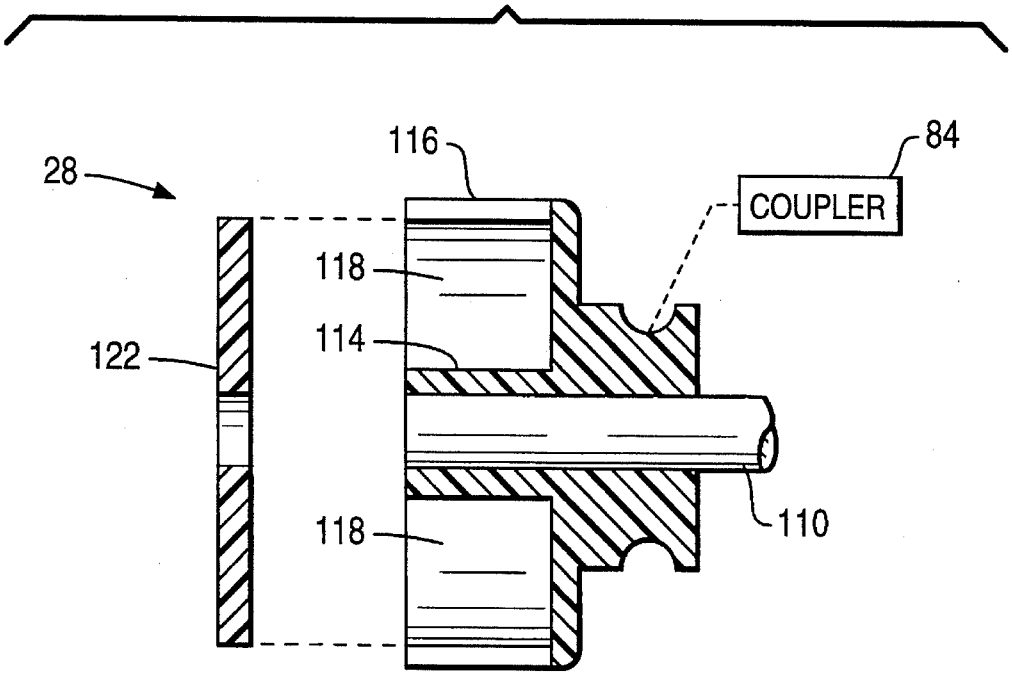
FIG. 7 is a cross-sectional view, taken along the line 7—7 of FIG. 6 to show additional details of the picker roller.

The design for the picker rollers 28 and 30 enable the top document 18-1 to be subjected to alternating high and low friction forces in the feeding direction 31, which direction is substantially perpendicular to the force which is perpendicular to the stack 18. The picker roller 28 has a general roller shape or cup shape, as shown in FIGS. 6 and 7, and it also has a tubular center post 114 which receives the shaft 110. The periphery of the roller 28 has slots 116 cut therein to provide arcuately-shaped areas 118. The roller 28 is made of low friction plastic material, and these arcuately-shaped areas provide a low friction drive relative to the document 18-1 being driven. Another part of the picker roller 28 includes a tire-like roller which is doughnut shaped and designated generally as doughnut 120. The doughnut 120 is made of a plastic foam or soft rubber material having a high coefficient of friction. In the embodiment described, the doughnut 120 is made of polyurethane and its surface is sprayed with a layer of urethane which provides for a high friction surface compared to the arcuately-shaped areas 118. Thereafter, the doughnut 120 is inserted into the interior of the cup-shaped roller 28, and a cap 122 is pushed into the interior of the roller 28 to cause the parts 124 of the doughnut to pass through the slots 116 in the roller 28 as shown in FIG. 6. The parts 124 of the roller 28 provide the high friction drive relative to the document 18-1. As the roller 28 rotates during the picking process, the document 18-1 is subjected to alternating low and high friction forces. This intermittent feeding action is especially beneficial is feeding documents which are very thin and have a very small weight in that it prevents the buckling of the paper between the picker roller 28 and the associated advance roller 66. The picker roller 28 also does not overdrive the document under the top document 18-1, and consequently, it minimizes double feeds. A conventional double detect sensor 126 (FIG. 3) may be used to detect two documents 18-1 being fed, and this sensor 126 is positioned between the left and right advance rollers 66 and 68 and the knurled rollers 94. When a double document 18-1 is detected, the controller 40 returns both of these documents to the hopper 14 as previously discussed in returning a single document 18-1 to the hopper 14. As an alternative, a request for operator intervention may be signalled on the display 64.

What is claimed is:

1. A sheet feeder comprising:

a hopper for storing a stack of documents to be fed, with said stack having a top and a bottom and with the documents in said stack positioned therein in a face-up position;

a picker mechanism including first and second picker rollers for picking a document from the top of said stack and for moving the document downstream in a feeding direction;

a leading edge detector including first, second, and third aligned sensors positioned downstream from said picker mechanism for generating first, second, and third outputs, respectively, as a leading edge of the document encounters the associated sensors;

first and second drive rollers positioned between said picker mechanism and said leading edge detector;

first and second motors for driving said first and second drive rollers independently of each other for moving said document, with said first and second picker rollers being coupled to said first and second motors to move said document in the same direction and at substantially the same speed as the associated first and second drive rollers;

a document receiver located downstream from said first and second drive rollers in said feeding direction for receiving said document from said first and second drive rollers; and a controller and a program for receiving said first, second, and third outputs to obtain a measure of skewness of said document approaching said first, second, and third sensors relative to said feeding direction and for controlling the operation of said first and second motors to present said document to said document receiver in a deskewed orientation with respect to said feeding direction.

2. The sheet feeder as claimed in claim 1 in which:

said picker mechanism includes:

first and second stripper rollers resiliently biased towards said first and second drive rollers, respectively, for eliminating double documents being fed from said hopper; and said first and second stripper rollers each have a one-way clutch enabling a said document to be fed in a direction opposite to said feeding direction.

3. The sheet feeder as claimed in claim 2 in which:

said program has a routine to enable said controller to energize said first and second motors to move said document back towards said hopper if said document takes longer than a predetermined amount of time in moving from said hopper to said document receiver; and said program has a second routine to enable said controller to utilize the outputs from said leading edge detector to deskew said leading edge of said document as said document is moved back towards said hopper.

4. The sheet feeder as claimed in claim 1 in which each of said first and second picker rollers has a periphery having alternating high friction and low friction areas thereon.

5. A sheet feeder comprising:

a hopper for storing a stack of documents to be fed;

a picker mechanism for picking a document from said stack and for moving the document downstream in a feeding direction;

a leading edge detector including first and second sensors positioned downstream from said picker mechanism for generating first and second outputs, respectively, as a leading edge of the document encounters said first and second sensors;

first and second drive rollers positioned between said picker mechanism and said first and second sensors;

first and second motors for driving said first and second drive rollers independently of each other;

a document receiver located downstream from said first and second drive rollers in said feeding direction for receiving said document from said first and second drive rollers;

a controller and a program for receiving said first and second outputs to obtain a measure of skewness of said document approaching said first and second sensors relative to said feeding direction and for controlling the operation of said first and second motors to present said document to said document receiver in a deskewed orientation with respect to said feeding direction; and said picker mechanism comprising first and second picker members coupled to said first and second drive motors, respectively, to enable said first and second picker members to move said document at substantially the same speed as the first and second drive rollers, respectively.

6. The sheet feeder as claimed in claim 5 in which said first and second picker members are in the form of first and second picker rollers, respectively, with each of said first and second picker rollers having a periphery having alternating high friction and low friction areas thereon.

7. The sheet feeder as claimed in claim 5 in which:

said hopper has a discharge end aligned perpendicular to said feeding direction to enable said picker mechanism to pick said document from said stack; and said hopper includes:

a bi-directional motor under the control of said controller;

and connecting linkage between said hopper and said bi-directional motor to enable said discharge end of said hopper to be moved towards and away from said picker mechanism.

8. The sheet feeder as claimed in 7 in which said hopper has a pivoting end opposite to said discharge end and a stationary member for pivotally mounting said pivoting end thereon.

9. The sheet feeder as claimed in claim 8 in which said picker mechanism includes:

first and second stripper rollers resiliently biased towards said first and second drive rollers, respectively, for eliminating double documents being fed from said hopper; and said first and second stripper rollers each having a one-way clutch enabling said document to be fed in a direction opposite to said feeding direction.

10. A sheet feeder comprising:

a hopper for storing a stack of documents to be fed;

a picker mechanism for picking a document from said stack and for moving the document downstream in a feeding direction;

a leading edge detector including first and second sensors positioned downstream from said picker mechanism for generating first and second outputs, respectively, as a leading edge of the document encounters said first and second sensors;

first and second drive rollers positioned between said picker mechanism and said first and second sensors;

first and second motors for driving said first and second drive rollers independently of each other;

a document receiver located downstream from said first and second drive rollers in said feeding direction for receiving said document from said first and second drive rollers;

a controller and a program for receiving said first and second outputs to obtain a measure of skewness of said document approaching said first and second sensors relative to said feeding direction and for controlling the operation of said first and second motors to present said document to said document receiver in a deskewed orientation with respect to said feeding direction;

said stack of documents having a top and a bottom and the documents in said stack being positioned therein in a face-up position to enable a top-most document to be the document removed by said picker mechanism; and said picker mechanism comprising first and second picker members coupled to said first and second drive rollers, respectively, to enable said first and second picker members to move said top-most document at substantially the same speed as the first and second drive rollers, respectively.

11. The sheet feeder as claimed in claim 10 in which said picker mechanism includes:

first and second stripper rollers resiliently biased towards said first and second drive rollers, respectively, for eliminating double documents being fed from said hopper; and said first and second stripper rollers each having a one-way clutch enabling a said document to be fed in a direction opposite to said feeding direction.

12. The sheet feeder as claimed in claim 11 in which said program has a routine to enable said controller to energize said first and second motors to move said document back towards said hopper if said document takes longer than a predetermined amount of time in moving from said hopper to said document receiver.

13. The sheet feeder as claimed in claim 12 in which said program has a second routine to enable said controller to utilize the outputs from said leading edge detector to deskew said leading edge of said document as said document is moved back towards said hopper.

14. A sheet feeder comprising:

a hopper for storing a stack of documents to be fed;

a picker mechanism for picking a document from said stack and for moving the document downstream in a feeding direction;

a leading edge detector including first and second sensors positioned downstream from said picker mechanism for generating first and second outputs, respectively, as a leading edge of the document encounters said first and second sensors;

first and second drive rollers positioned between said picker mechanism and said first and second sensors;

first and second motors for driving said first and second drive rollers independently of each other;

a document receiver located downstream from said first and second drive rollers in said feeding direction for receiving said document from said first and second drive rollers;

a controller and a program for receiving said first and second outputs to obtain a measure of skewness of said document approaching said first and second sensors relative to said feeding direction and for controlling the operation of said first and second motors to present said document to said document receiver in a deskewed orientation with respect to said feeding direction;

said first and second motors being stepper motors;

said document receiver including:

transport rollers to receive said document from said drive rollers and move said document in said feeding direction; and a transport motor for driving said transport rollers;

said controller and program being effective to place said first and second stepper motors in a "coast" mode, as soon as said document has engaged said transport rollers and said transport motor is energized, so as to minimize drag on the document by said first and second stepper motors.

15. A sheet feeder comprising:

a hopper for storing a stack of documents to be fed;

a picker mechanism for picking a document from said stack and for moving the document downstream in a feeding direction;

a leading edge detector including first and second sensors positioned downstream from said picker mechanism for generating first and second outputs, respectively, as a leading edge of the document encounters said first and second sensors;

first and second drive rollers positioned between said picker mechanism and said first and second sensors;

first and second motors for driving said first and second drive rollers independently of each other;

a document receiver located downstream from said first and second drive rollers in said feeding direction for receiving said document from said first and second drive rollers;

a controller and a program for receiving said first and second outputs to obtain a measure of skewness of said document approaching said first and second sensors relative to said feeding direction and for controlling the operation of said first and second motors to present said document to said document receiver in a deskewed orientation with respect to said feeding direction;

said leading edge detector including a third sensor positioned between said first and second sensors;

said stack of documents having a top and a bottom and the documents in said stack being positioned therein in a face-up position to enable a top-most document to be the document removed by said picker mechanism; and said picker mechanism comprising:

first and second stripper rollers resiliently biased towards said first and second drive rollers, respectively, for eliminating double documents being fed from said hopper; and said first and second stripper rollers each having a one-way clutch enabling said document to be fed in a direction opposite to said feeding direction.

16. The sheet feeder as claimed in claim 15 in which:

said sheet feeder includes a doubles detect sensor positioned between said first and second drive rollers and said transport rollers for generating an output when two documents are detected; and said controller is effective to energize said first and second motors to return said two documents to said hopper.

17. A method of aligning a leading edge of a document perpendicular with regard to a feeding direction, comprising the steps of:

(a) using independently driven first and second drive wheels for feeding the document so that the leading edge approaches a leading edge detector providing outputs as the leading edge encounters the lead detector;

(b) using the outputs from the leading edge detector to energize first and second reversible motors, respectively, driving said first and second drive wheels to enable the leading edge to assume a position perpendicular to the feeding direction prior to the leading edge approaching a receiving member; and (c) driving the first and second drive wheels in a direction opposite to the feeding direction to facilitate aligning the leading edge perpendicular to the feeding direction if the leading edge of the document takes more than a predetermined amount of time when driven in the feeding direction;

steps (a) and (b) being performed in the feeding direction which moves the document away from a hopper from which the document was withdrawn.

18. A sheet feeder for feeding sheets in a feeding direction from a single stack of intermixed sheets of different sizes and different thickness, the sheet feeder comprising:

a hopper unit for storing a single stack of intermixed sheets of different sizes ranging from about a minimum of about 2¾×4¾ inches to a maximum of about 11.7×17 inches and different thickness ranging from a minimum of about 0.003 inch to a maximum of about 0.012 inch, the hopper unit including an aligner member aligned parallel to the feeding direction and against which one side of each sheet of the single stack of intermixed sheets contacts;

a picking unit for picking a sheet from the single stack of intermixed sheets;

means coupled to the picking unit and for cooperating with the picking unit to ensure that only one sheet is picked at a time from the single stack of intermixed sheets independent of the different sizes and different thickness of the sheets;

a sensing unit positioned downstream relative to the feeding direction and for producing a number of output signals when a leading edge of a picked sheet is encountered; and a control unit for controlling the means to position the leading edge of the picked sheet substantially perpendicular to the feeding direction in response to the output signals of the sensing unit.

19. A sheet feeder according to claim 18, wherein the picking unit includes first and second picker members in the form of first and second picker rollers, each of the first and second picker rollers having a periphery having alternating high friction and low friction areas thereon.

* * * * *